United States Patent [19]

Ferris et al.

[11] 3,964,766

[45] June 22, 1976

[54] FIFTH WHEEL PLATE ASSEMBLY

[75] Inventors: Ray L. Ferris, Thornton, Ill.; Walter J. Marulic, Gary, Ind.

[73] Assignee: Pullman Incorporated, Chicago, Ill.

[22] Filed: Feb. 12, 1975

[21] Appl. No.: 549,255

[52] U.S. Cl. ..... 280/433
[51] Int. Cl.[2] ..... B62D 53/10
[58] Field of Search ..... 280/433, 434; 105/368 S

[56] References Cited

UNITED STATES PATENTS

| | | | |
|---|---|---|---|
| 2,861,818 | 11/1958 | Kayler et al. | 280/434 |
| 3,751,079 | 8/1973 | Marulic et al. | 105/368 S |

*Primary Examiner*—M. H. Wood, Jr.
*Assistant Examiner*—R. Schrecengost
*Attorney, Agent, or Firm*—Richard J. Myers

[57] ABSTRACT

A fifth wheel plate assembly for a trailer hitch for securing trailers to railway flat cars includes a top plate having an opening in which a movable clamp or lock jaw is supported for grasping and locking the kingpin of a trailer to the fifth wheel. The lock jaw is provided with slidable extensions which are engaged by a lock screw mounted below the fifth wheel plate and which moves the lock jaw between open and closed positions. When in a closed position a slidable bolt assembly is movable transversely of the extensions into keeper openings within the extensions for maintaining the locking jaw in its closed position. The locking bolt is slidable in a tube provided with a diagonal recess which accommodates the stem of a manually operated handle for sliding the locking bolt. A flag or indicator is pivotally mounted underneath the top plate on an axis parallel to the axis of the locking bolt. The indicator includes an arm at one end and a flag at the other end. When the bolt is in a locked position relative to the keepers on the extension the flag is visible having pivoted by gravity to a lowered position and when the bolt is in an unlocked position the flag is out of sight shielded to the view of the operator.

6 Claims, 6 Drawing Figures

UNLOCK POSITION

LOCK POSITION

FIFTH WHEEL PLATE ASSEMBLY

A related patent application is Ser. No. 548,507 filed Feb. 10, 1975.

BACKGROUND OF THE INVENTION

1. Field of the Invention

The invention pertains to fifth wheel assemblies and particularly to the type of fifth wheel plate which is utilized in connection with a trailer hitch for connecting trailers on railway flat cars.

2. Description of the Prior Art

The prior art over which the present invention is an improvement is particularly disclosed in U.S. Pat. No. 3,751,079 patented Aug. 7, 1973.

SUMMARY

It is a prime object of the present invention to provide an improved fifth wheel plate for securing the kingpins of trailers supported on trailer hitches during trailer-on-flat car operations. A more specific object is the provision of an improved locking arrangement for grasping the kingpin of the trailer into locked position relative to a fifth wheel plate. This arrangement includes a locking jaw cooperating with the opening of the fifth wheel plate and including extensions which are slidably supported underneath the fifth wheel plate. The extensions and locking jaw are moved by means of a rotatable drive screw. In order to lock the clamping jaw in a locked position, a slide bolt is moved laterally through keeper openings provided in the lock jaw extensions. An indicating mechanism is provided for indicating to the operator either the locked or unlocked position of the locking bolt and clamp jaw assembly. The indicator comprises an arm which is pivotally mounted on an axis substantially parallel to the axis of the locking bolt. The indicator includes a cam on one end and a flag portion at the other end. When the locking bolt is in the locked position the camming end of the arm is engaged with one side of the lock bolt and the flag is positioned downwardly in a position where it is readily visible to the operator. On the other hand when the locking bolt is moved to an unlocked position the camming end of the arm is positioned and held on the lower edge of the locking bolt and the flag is positioned in a shielded manner no longer visible to the operator.

These and further objects and advantages of the invention will become more readily apparent from a reading of the following descriptions.

DESCRIPTION OF THE PREFERRED EMBODIMENT

Figure 1:
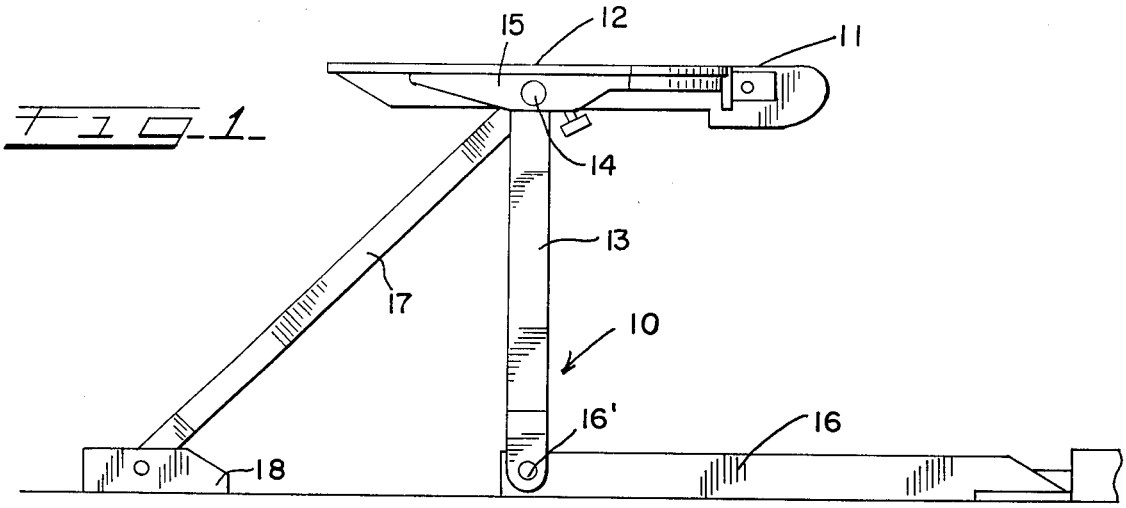
FIG. 1 is a side elevational view of a trailer hitch of a type adapted to be positioned on a railway flat car for securing trailers thereto.

As best shown in FIG. 1 a trailer hitch 10 includes a fifth wheel 11 having a top plate 12. The top plate 12 is supported on an upright pedestal 13 pivotally connected by means of a pivot pin 14 to brackets 15 (only one being shown) projecting downwardly below the top plate 12. The present trailer hitch is of a type which is pivotally supported at the end of a cushioning device 16 carried on the floor of a conventional flat car. The pedestal and trailer hitch assembly may be collapsed and pivoted about a pivot pin 16' of the cushioning unit 16 in a manner which is conventional and is disclosed in the Ferris et al. U.S. Pat. No. 3,493,207. The trailer hitch also includes diagonal supports 17 suitably pivotally connected to a pivot bracket 18 adapted to be secured to a railway flat car.

Figure 2:
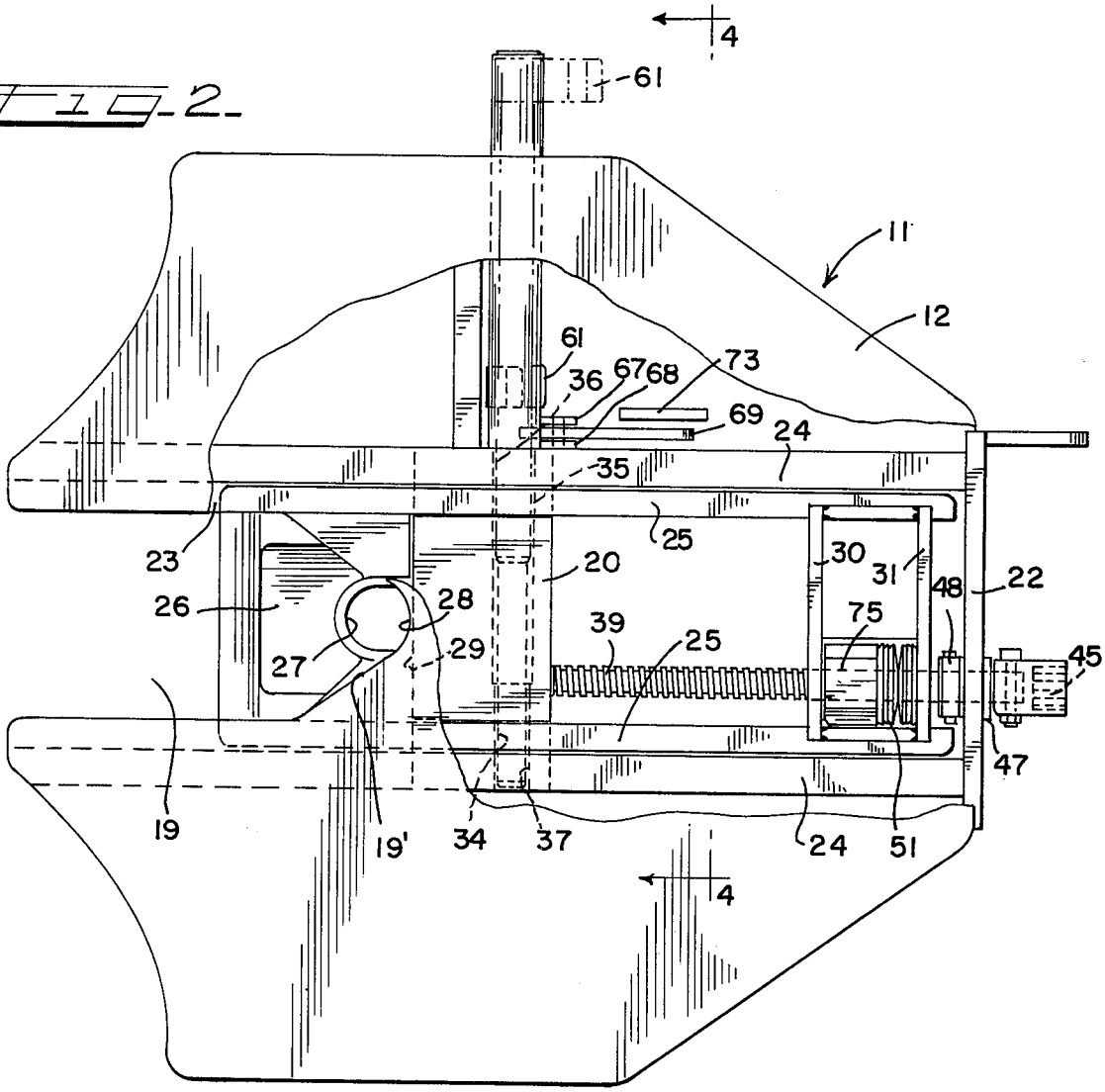
FIG. 2 is a plan view of a top plate of a fifth wheel for trailer hitches with portions broken away to better illustrate the invention.

Referring now particularly to the top plate 12 an enlarged slot 19 is provided which terminates at one end thereof and at its other includes diverging gathering surfaces 19'. An enlarged lateral support member 20 is rigidly connected to the underneath surface of the top plate 12 and projects downwardly with respect thereto. The top plate 12 also includes side flanges 21 as best shown in FIG. 4 and an end support member 22 projecting downwardly at one end of the plate 12 as shown in FIG. 2. A pair of laterally spaced slide support cut outs 23 are formed in the support member 20 as best shown in FIG. 4. Laterally spaced slide members 25 provide a slide assembly which is guided on the slide supports 23. The slide members 25 at one end are rigidly secured to a jaw or clamping block 26 having an arcuate kingpin engageable surface or socket 27 as best shown in FIG. 2. The kingpin engageable surface 27 is adapted to complement a kingpin receiving surface 28 formed in the top plate 12 at the ends of the diverging surfaces 19'. A vertical face or wall 29 on the block 20 also provides for supporting and locking a trailer connected kingpin (not shown) within the kingpin engageable surface or socket 27. A pair of parallel bars or brackets 30 and 31 connect the other ends of the slide members 25. As best shown in FIG. 4, the slide members 25 are retained on the slide supports 23 by means of parallel stationary guide walls 24. As indicated in FIG. 3 each of the bars 30 and 31 are respectively provided with bores 32 and 33 in longitudinal alignment.

As best shown in FIG. 4, the slide members 25 include laterally extending bores 34 and 35 with said bores also being in alignment. The guide walls 24 are respectively provided with bores 36 and 37 in turn adapted to be aligned with the bores 34, 35, 36 and an alongated bore 38 extending through the support block or member 20.

Figure 3:
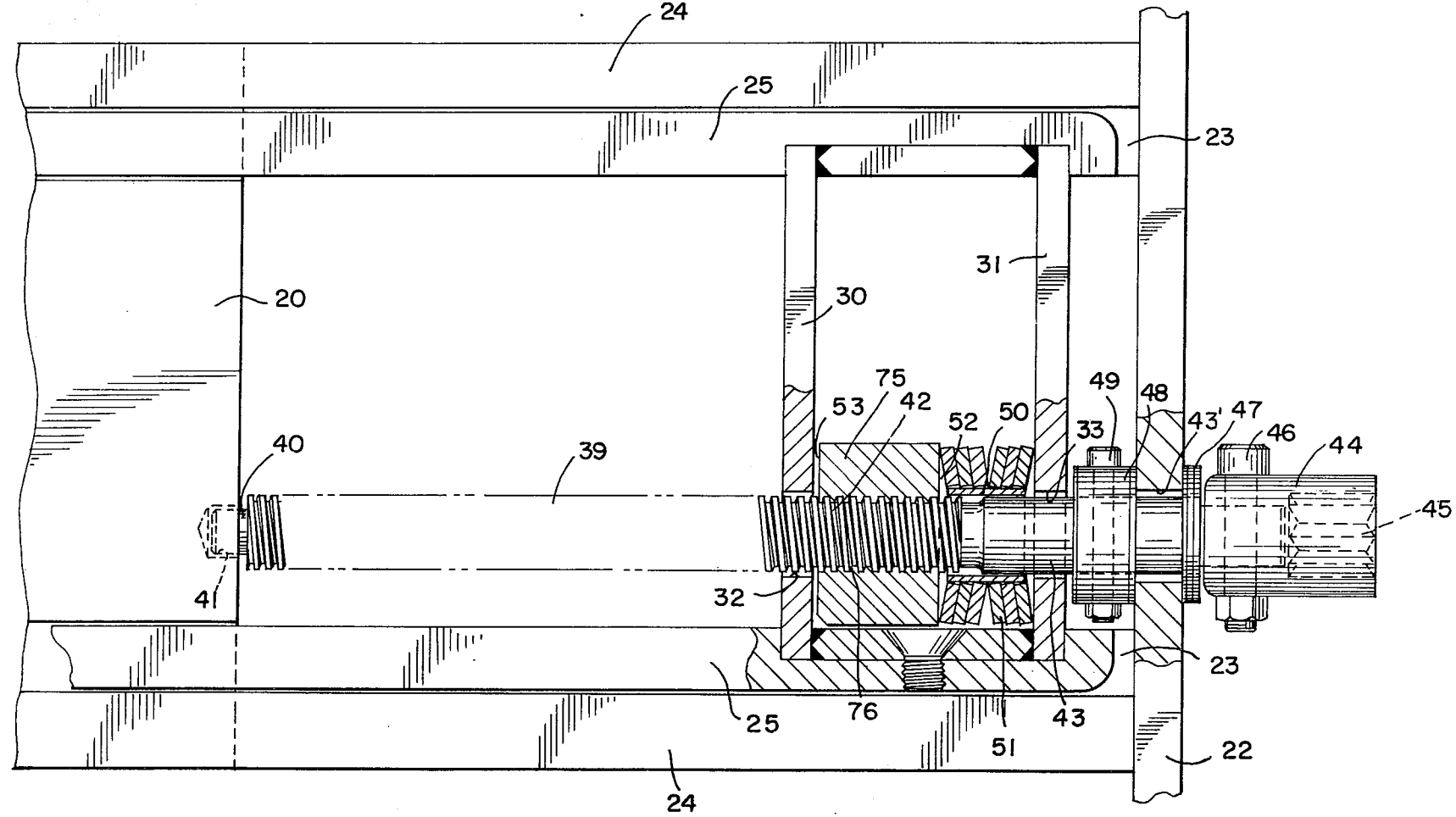
FIG. 3 is an enlarged view showing a drive mechanism for actuating a clamping jaw to clamp the kingpin of a trailer.
Figure 4:
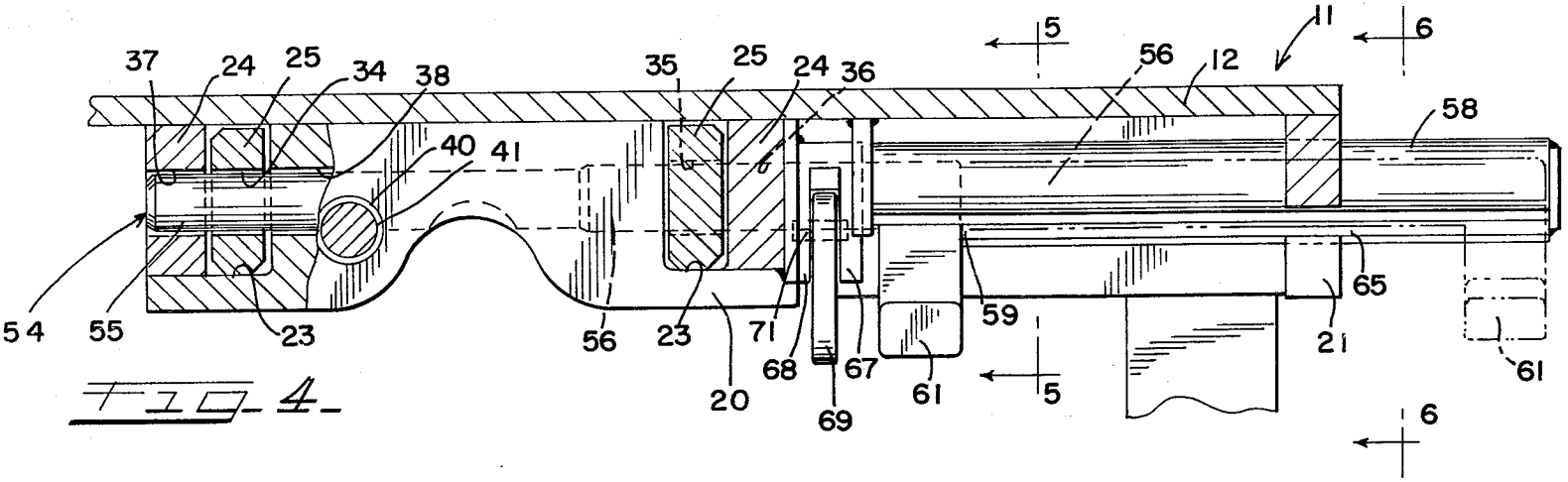
FIG. 4 is a cross-sectional view taken substantially along the line 4—4 of FIG. 2.
Figure 6:
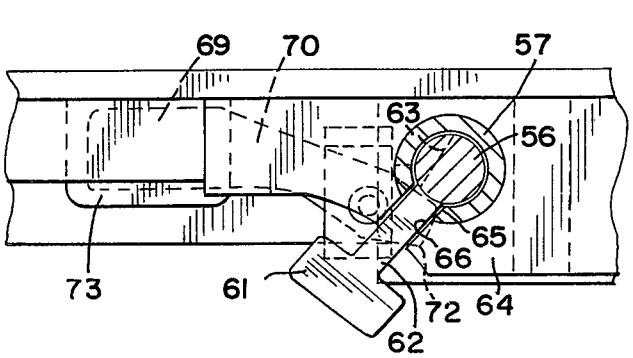
FIG. 6 is a cross-sectional view taken substantially along the line 6—6 of FIG. 4.
Figure 5:
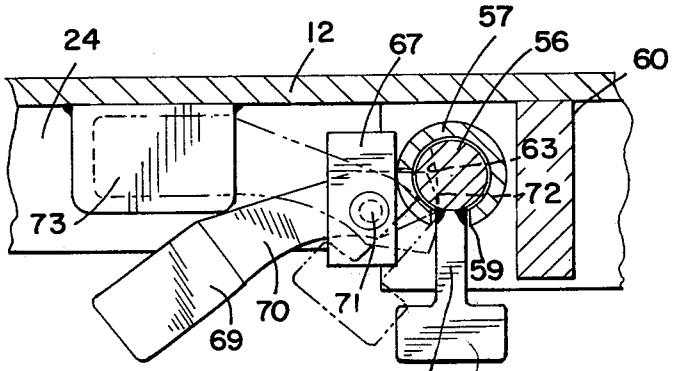
FIG. 5 is a cross-sectional view taken substantially along the line 5—5 of FIG. 4.

A drive screw 39 as shown in FIGS. 2 and 3 includes a reduced journal portion 40 provided in the block 20. The drive screw 39 includes a threaded portion 42 connected to a bearing portion 43 projecting through a bore 43' provided in the end support member 22. The portion 43' has connected thereto an operation head 44 provided with a wrench engageable socket 45. The socket members or head 44 is rigidly connected to rotate the drive screw 39 by means of a bolt and nut assembly 46. A thrust collar 47 is positioned on the bearing portion 43 between the socket member 44 and the support member 22. On the other side of the end support member 22 there is also provided a thrust ring 48 supported on the bearing portion 43 and rigidly connected thereto by means of a bolt and nut assembly 49. Thus the drive screw 39 is supported against longitudinal movement by means of the thrust collar 47 and ring 48. A sleeve 50 is journaled on the bearing portion 43 ans supports thereon a plurality of concave-convex spring washers 51 which are supported in an arrangement to provide an effective spring or cushioning assembly disposed between a vertical surface 52 of a follower block 75 and the inner face of the bracket member 31. The follower block 75 includes a threaded bore 76 engaged by the drive screw 39. The arrangement of the concave-convex springs is also known in the trade as a belleville spring arrangement the same being disposed in the arrangement shown to provide an effective spring-like cushioning to dampen thrust forces to which a kingpin is subjected during over-the-road operation. As best shown in FIG. 4 a locking pin or bolt 54 is provided at one end with a reduced diameter portion 55 and at its other end a larger diameter portion 56. The locking pin 54 is adapted to be reciprocated within a tube 57 which includes an extension 58 projecting outwardly from the side flange 21 as best shown in FIG. 4. The tube 57 is rigidly secured underneath the top plate 12 and includes a short vertical lower slot 59 as best shown in FIGS. 4 and 5. A vertical wall 60 connected to the top plate 12 extends parallel to the tube 57. A handle 61 is connected to the larger diameter portion 56 of the locking pin 54, the said handle 61 including a stem 62 which is adapted to be moved into the slot 59. As best shown in FIG. 5, a portion of the large diameter portion 56 adjacent to the stem 62 is provided with an undercut flat recess 63. The tube 57 as best shown in FIG. 6 is also provided with an elongated diagonal guide slot 65 which is in registry with a diagonal slot 66 formed in support structure 64 positioned underneath and projecting downwardly from the top plate 12. During sliding movement of the bolt 54 the stem 62 is guidedly moved in the slot 66. Spaced bracket portions 67 and 68 as best shown in FIGS. 4 and 5 are suitably secured to the top plate 12 and project downwardly with respect thereto the same pivotally supporting a flag and indicator 69 having an arm 70, as shown in FIG. 5, which is pivotally connected by means of a pivot pin 71 to the brackets 67 and 68. The axis of the pivot pin 71 is substantially parallel to the axis of the bolt 54. The end of the arm 70 is provided with a cam surface 72 which as best shown in FIG. 5 is adapted to engage the flat portion 63 of the shaft 56. A shield 73 also projects downwardly from the top plate 12 as indicated which as shown in FIG. 6 in the unlocked position hides the flag 69 from view of the operator.

THE OPERATION

The operation of the drive screw 39 in moving the clamping block 26 to its locked or kingpin engaging position is more specifically described in the above related application. Briefly, rotation of the socket member 44 by the insertion of a wrench in the wrench engageable socket 45 provides for movement of the clamping jaw 26 into the closed position shown in FIG. 2. Reverse movement of the drive screw 39 provides for the clamping jaw 26 to be moved to its open position to the left of the position shown in FIG. 2 whereupon the trailer kingpin may be disengaged from the surface 28 and the jaw is in its open position. The present invention relates to the locking means for effectively assuring that in the closed position of the jaw 26 the same will be securely and positively locked, the information being indicated to the operator who is engaged in the actuation of the mechanism. As best shown in the dotted line position of FIG. 4 the locking bolt 54 and handle 61 is moved from its outermost position to its innermost position as shown in the full line position. As indicated in FIG. 4 the locking bolt 54 then is in registry with the openings 34 and 35 of the slide bars 25 so as to retain the jaw in its closed and locked position. To initially move the locking bolt 54 to the said position of FIG. 4 the handle 61 is grasped by the operator and the stem 62 slides in the diagonal slots 65 and 66. Prior to the movement of the bolt 54 to its closed position the flag or indicator 69 is in the position shown in FIG. 6 which is the unlocked position. In this position the flag end 69 is disposed out of view in back of the shield 73. The arm 70 is held in this upward position since the end of the arm 70 which includes the cam 72 is disposed beneath the large diameter portion 56 of the bolt 54. Since the arm is pivoted on a pivot 71 which is substantially parallel to the axis of the bolt 54 the arrangement is such that the indicator flag 69 is thus maintained during the sliding movement of the bolt in the hidden position as shown in FIG. 6.

As movement of the bolt 54 continues into the locked position the stem 62 of the handle 61 moves into the full line position shown in FIG. 4 where it is rotated to a substantially vertical position shown in FIG. 5 from the unlocked position shown in FIG. 6. Rotation of the handle 61 thus then provides for the stem 62 to move into the short vertical slot 59 provided within the tube 57 as best shown in FIG. 4. Upon rotation of the handle 61 to the position shown in FIG. 5 the flag end 69 now drops vertically by gravity, pivotally about the pivot 71, the cam end 72 then moving into flat undercut portion 63 of the bolt 54 and enlarged diameter portion 56, whereupon it is then held in the down visible position as shown in FIG. 5 which indicates that the bolt is now locked in position.

With the arrangement shown it is of course now clear that it is now virtually impossible for the clamping jaw to be aaccidentally unlocked during the trailer on flat car operations. When the railway car reaches its destination and it is desired to remove the trailers from the cars the operator reverses the procedure above described. The operator grasps the flag end 69 of the indicator and lifts it vertically behind a shield 73 simultaneously withdrawing the bolt 54 outwardly to the dotted line position shown in FIG. 4 wherein the handle is indicated as having reached its extreme outer end of the tube 57. As the bolt is initially withdrawn the handle 61 is moved into registry with the diagonal slot 65 and movement of the stem 62 is through the diagonal slots 65 and 66. As shown in FIG. 6 the flag and indicator 69 is maintained in the shielded position since the cam 55 is now positioned below the bolt 54 and is held in the said position during the unlocked position of the jaw and bolt assembly.

Thus it is believed a positive locking mechanism for locking the clamping jaw has been provided and an effective and highly visible signalling and indicating means alerts the operator to the locked or unlocked position of the bolt even though the operator may be standing on the ground a distance away from the railway car. He will know that when the flag is not visible that the bolt is not locked properly. On the other hand when the flag is visible clearly as shown in FIG. 5 he immediately knows that the bolt is securely locked and that the clamping jaw is in proper position relative to the trailer kingpin of a trailer and thus safe and secure operation is assured.

What is claimed is:

1. A fifth wheel for connection to the kingpin of a highway trailer comprising:

a top plate having a substantially rectangular opening including parallel side walls and converging walls terminating in a kingpin receiving seat, slide supports below said top plates, a clamping member slidable on said supports, said clamping member having clamping recess forming with said kingpin receiving seat a kingpin retaining means, slide means connected to said clamping member supported on said slide supports and movable longitudinally with respect thereto, and means for moving said slide means and clamping means between kingpin engaging and non-engaging positions, a lock assembly including a locking bolt having manual operating means, guide means slidably supporting said locking bolt below said top plate, keeper means on said slide means adapted to be engaged by said slide bolt during manual operation of said operating means to lock said clamping means in said kingpin engaging position, the improvement comprising:

signalling means for indicating locking and unlocking positions of said locking bolt including an indicating member having an arm, bracket means supported by and below said top plate, pivot means connecting said arm to said bracket means on an axis substantially parallel to the axis of said locking bolt, said locking bolt including a recess on said bolt providing a stop seat engaging a portion of said arm, said arm portion having a camming surface thereon engaging said seat when said bolt is in said locked position and having a second surface thereon engaging said bolt when said bolt is in said unlocked position, and the other end of said arm having a signal portion which is gravitationally urged downwardly when said camming surface engages said seat to indicate said locked position of said bolt.

2. The invention in accordance with claim 1, said guide means including a tube extending normal to said slide means.

3. The invention in accordance with claim 2, said tube having a longitudinally extending slot, said bolt including means engageable with said slot to be guided therein during sliding movement of said bolt.

and means on said tube permitting shifting at said slide bolt to said first lock position.

4. The invention is accordance with claim 3, said means are said tube permitting shifting of said slide bolt including a second slot on said tube communicating with said first slot and being radially off-set with respect thereto.

5. The invention in accordance with claim 1 having means on said top plate shielding said signal portion from view of an operator in the unlocked position.

6. The invention in accordance with claim 1, said pivot means being eccentrically positioned relative to one end of said arm whereby said other end including said signalling means is moved to said first lock position.

* * * * *